US007579565B2

(12) United States Patent
Al Dosari

(10) Patent No.: US 7,579,565 B2
(45) Date of Patent: Aug. 25, 2009

(54) MECHANICAL TIMER SWITCH ASSEMBLY

(76) Inventor: Shafi Al Dosari, P.O. Box 7184, Fahaheel (KW) 64002

( * ) Notice: Subject to any disclaimer, the term of this patent is extended or adjusted under 35 U.S.C. 154(b) by 0 days.

(21) Appl. No.: 10/941,927

(22) Filed: Sep. 16, 2004

(65) Prior Publication Data

US 2009/0152085 A1 Jun. 18, 2009

(51) Int. Cl.
*H01H 9/00* (2006.01)

(52) U.S. Cl. ..... 200/330; 200/331; 307/141.4

(58) Field of Classification Search ..... 200/330, 200/331, 33 R–33 D, 38 R–38 CA, 35 W, 200/37 R, 37 A; 174/48–51, 66, 67; 307/141, 307/141.4; 315/360, 362; 361/195
See application file for complete search history.

(56) References Cited

U.S. PATENT DOCUMENTS

| | | | | | |
|---|---|---|---|---|---|
| 2,853,932 | A | | 9/1958 | Freydl | |
| 3,179,758 | A | | 4/1965 | Trock | |
| 3,353,191 | A | | 11/1967 | Dahly | |
| 3,740,680 | A | * | 6/1973 | Schneidinger | 335/59 |
| 3,985,982 | A | | 10/1976 | Schneidinger | |
| 4,194,182 | A | | 3/1980 | Martin | |
| 4,349,748 | A | * | 9/1982 | Goldstein et al. | 307/132 E |
| 4,360,739 | A | * | 11/1982 | Goldstein | 307/132 E |
| 4,835,413 | A | | 5/1989 | Nilssen | |
| 4,942,806 | A | | 7/1990 | Hwang | |
| 5,099,752 | A | | 3/1992 | Bosley | |
| 5,131,888 | A | | 7/1992 | Adkins, II | |
| 5,148,736 | A | | 9/1992 | Juang | |
| 5,344,361 | A | | 9/1994 | Matthias | |
| 5,397,869 | A | * | 3/1995 | Huen | 200/330 |
| 5,638,947 | A | * | 6/1997 | Fenne | 200/293 |
| 5,687,573 | A | | 11/1997 | Shih | |
| 6,030,285 | A | | 2/2000 | Chen | |
| 6,175,782 | B1 | | 1/2001 | Obradovich et al. | |
| 6,692,130 | B1 | | 2/2004 | Snow | |

* cited by examiner

*Primary Examiner*—Michael A Friedhofer
(74) *Attorney, Agent, or Firm*—Lowe Hauptman Ham & Berner, LLP

(57) ABSTRACT

A mechanical timer switch assembly for replacing a mechanical on/off toggle switch includes a replacement cover plate having an inner and outer side and adapted to fit over and be attached to a conventional electrical receptacle box. The assembly also includes a mechanical spring actuated rotary timer switch having a spring, a rotatable shaft and a contact member which is movable by the shaft to open and close an electrical circuit. The spring actuated rotary timer switch is sized to fit into an electrical receptacle box and is fixed to the inner side of the replacement cover plate with a shaft extending through the cover. A knob having an indicator corresponds to time intervals indicated on the replacement cover plate to indicate the amount of time which will be elapsed by the movement of the timer before turning a light off. The assembly includes a second mechanical on/off switch preferably a push button switch which is fixed to the inner side of the replacement cover plate with an actuating member extending through the replacement cover plate for opening and closing an electrical circuit, i.e., turn a light on or off.

6 Claims, 3 Drawing Sheets

FIG.1
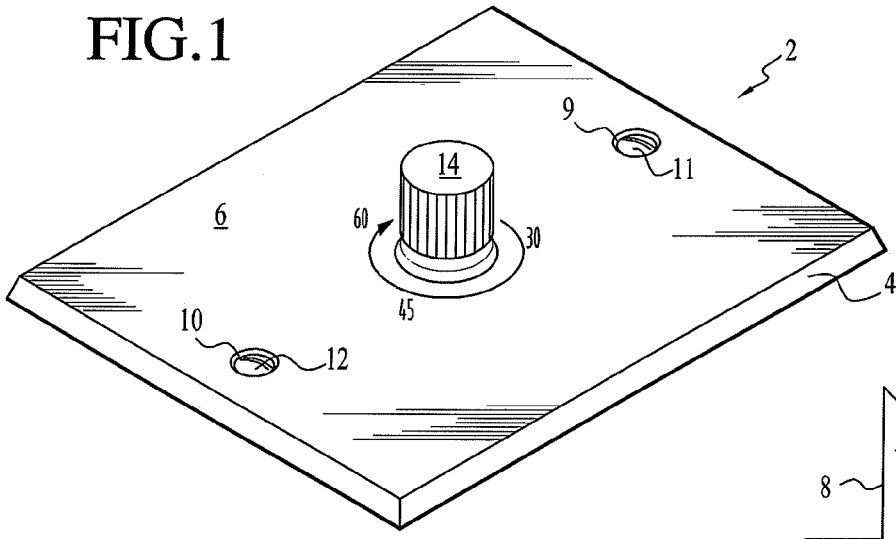
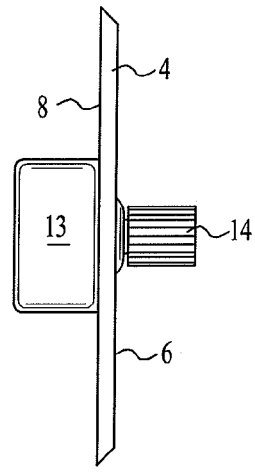
FIG.2
FIG.3
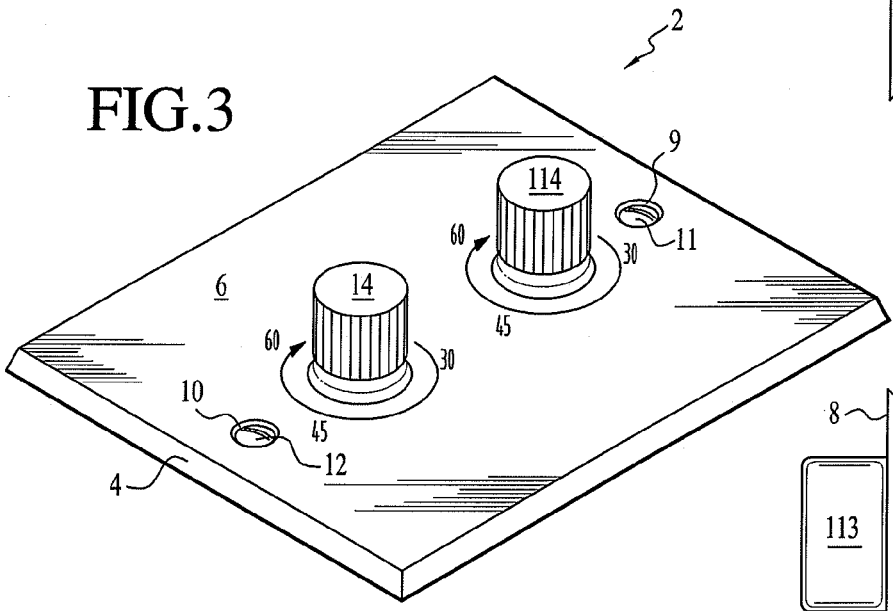
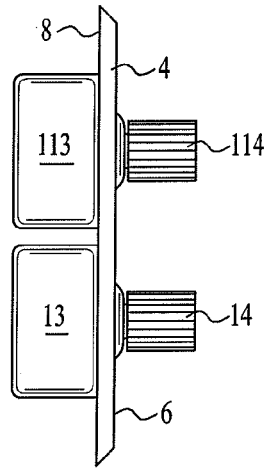
FIG.4

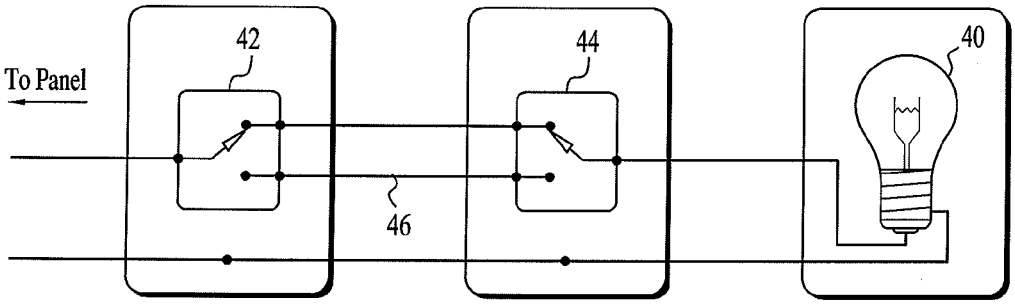
FIG.8
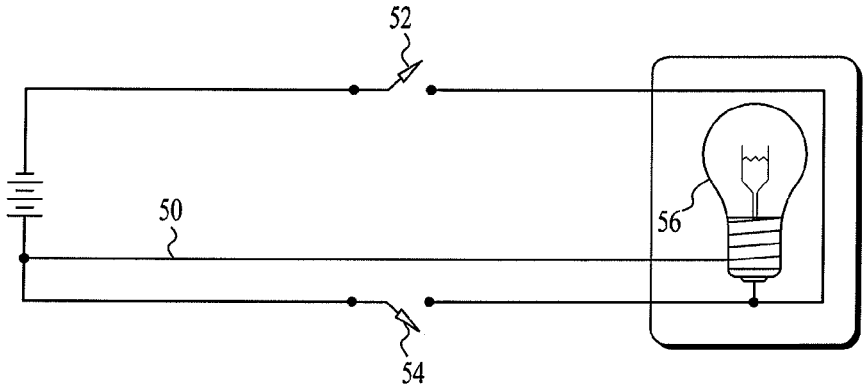
FIG.9
FIG.10
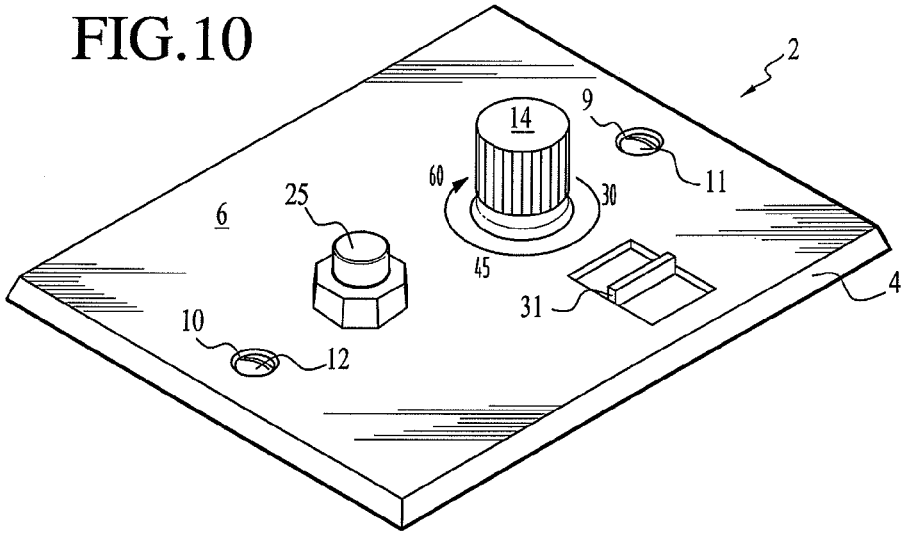

MECHANICAL TIMER SWITCH ASSEMBLY

FIELD OF THE INVENTION

This invention relates to a mechanical timer switch assembly for replacing an on/off toggle switch and more particularly to a mechanical timer switch assembly that includes a spring actuated rotary timer switch and a second mechanical on/off switch which is not a toggle mechanism.

BACKGROUND OF THE INVENTION

Automatic timers for operating toggle switches to turn lights on and off are known. For example, a continuously cycling automatic timer attachment for a wall mounted toggle switch is disclosed in the Trock U.S. Pat. No. 3,179,758. A Schneidinger U.S. Pat. No. 3,985,982 discloses a light switch actuating device which is mounted onto a wall space and actuates a toggle switch in a room and includes a single override switch.

Electronic wall switches are also well known. For example, the Martin U.S. Pat. No. 4,194,182 discloses an electrical switch controllable alternately by an internal timer and a digital information from a remote source. As disclosed therein, an electrical timer is used to turn a light on and off. An electronic wall switch is also disclosed in a Nilssen U.S. Pat. No. 4,835,413. As disclosed therein, a compact lightweight electronic actuator which is mounted on the outside of an ordinary wall switch and operable to permit touch-operated time automatic actuation of the wall switch actuating lever.

Notwithstanding the above, it is now believed that there may be a large commercial market for an improved mechanical timer switch in accordance with the present invention. It is believed that there is a commercial market because the switches in accordance with the present invention can be easily and safely installed by a homeowner at a relatively low cost. Further, such switch assemblies incorporate a mechanical as opposed to an electrical timer to turn the lights on and off.

Further advantages of the mechanical timer switch assemblies in accordance with the present invention reside in its compact assembly which is incorporated within a conventional electrical receptacle box with only a relatively small rotatable knob, one or two push button switches and a locking switch on the outside of the receptacle box cover plate. The rotatable knob and push button switch are on the outside of the cover plate, but do not extend outwardly by much more than an electrical toggle switch. For comparison, the aforementioned prior art patents with the exception of Martin, U.S. Pat. No. 4,194,182 include mechanisms on the outside of the cover plate. Also, each of the aforementioned patents incorporate a toggle lever which has been eliminated in the presently disclosed assembly.

An additional advantage of the present invention resides in the use of a mechanical switch to automatically turn off a light after a pre-selected time. Further, a simple three way switch circuit may be used to connect the rotary timer switch and a push button switch or other type of switch in a manner that minimizes the need for an electrician to install the switch. In addition, the mechanical timer switch assemblies in accordance with the present invention can be manufactured at a relatively low cost, are durable and readily installed in a conventional receptacle box and eliminates the need for a mechanical mechanism to actuate a conventional toggle switch. These and other advantages will be readily apparent from the detailed description of the invention that follows.

BRIEF SUMMARY OF THE INVENTION

In essence, the present invention contemplates a mechanical timer switch assembly for replacing a mechanical on/off toggle switch. The mechanical timer switch assembly includes a replacement cover plate having an inner and outer surface and adapted to fit over and be attached to an electrical receptacle box as a replacement for a conventional toggle switch cover plate. The assembly also includes a mechanical spring actuated rotary timer switch having a spring, a rotatable shaft and a contact member which is moveable by the shaft to open and close an electrical circuit. The mechanical spring actuated rotary timer switch is sized to fit into an electrical receptacle box and is fixed to the inner side of the replacement cover plate with the shaft extending through the cover plate.

A knob having time intervals thereon is fixed to the shaft for rotating the shaft to close an electrical circuit to turn a light on for a pre-selected interval of time. The spring and rotatable shaft comprise a timer mechanism so that an individual can use the time intervals on the knob to select a time period for the light to remain on.

The assembly also includes a second mechanical on/off switch preferably a push button switch fixed to the inner side of the replacement cover with an actuating member such as a push button extending through the replacement cover for opening and closing an electrical circuit, i.e., to turn a light on or off. In addition, an electrical circuit to provide for connecting the mechanical spring actuated rotary timer switch, the second mechanical on/off switch and an electric light to a source of electrical energy so that the electric light can be turned on or off by either switch. In one embodiment of the invention the electrical circuit is a three way switch circuit.

The invention will now be described in connection with the accompanying drawings wherein like numerals are used to designate like parts.

DESCRIPTION OF THE DRAWINGS

FIG. 1 is a perspective view of a mechanical timer switch according to a first embodiment of the invention;

FIG. 2 is a side view of the mechanical timer switch shown in FIG. 1;

FIG. 3 is a perspective view of a mechanical timer switch according to a second embodiment of the invention;

FIG. 4 is a side view of the mechanical timer switch shown in FIG. 3;

FIG. 8 is a diagram of an electric circuit of a type used in the present invention;

FIG. 9 is a drawing of a different electric circuit of a type used in the present invention; and FIG. 10 is a schematic illustration of a preferred embodiment of the invention.

DESCRIPTION OF THE PREFERRED EMBODIMENTS OF THE INVENTION

Figure 5:
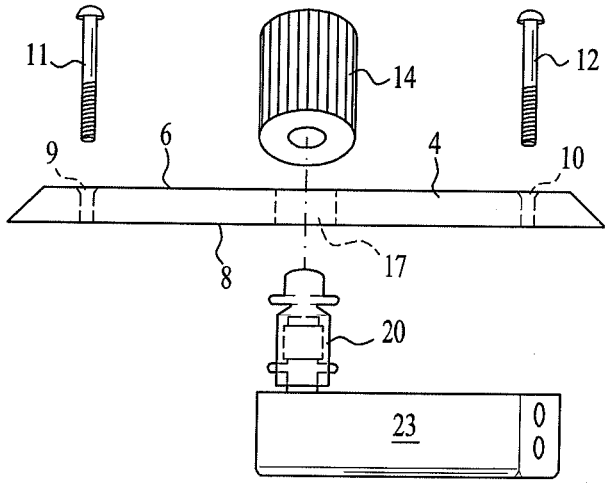
FIG. 5 is a schematic illustration of a mechanical timer switch in accordance with one embodiment of the invention.

As illustrated in FIGS. 1, 2 and 5, a mechanical timer switch assembly 2 is constructed and arranged to replace a conventional toggle switch and to fit within a conventional electrical receptacle box (not shown) of the size and type to accommodate an ordinary toggle type light switch. The switch assembly includes a replacement cover plate 4 having an outer surface 6 and an inner surface 8, and a thickness which is about the same or only slightly thicker then a conventional cover plate.

The replacement cover plate 4 is also dimensioned to have the same height and width as a conventional cover plate and includes a pair of tapered openings 9 and 10 for receiving screws 11 and 12 (FIG. 5) which are aligned with the openings in a conventional cover plate i.e., adapted to be screwed into a conventional electrical receptacle box.

A rotatable knob 14 is disposed on the outer surface 6 of the replacement cover plate 4 and is connected to a mechanical timer switch 13 by means of a shaft assembly 20 (FIG. 5) which passes through an opening 17 in the cover plate 4. In the first embodiment of the invention, the knob 14 is rotatable clockwise to turn a light on and to set the amount of time which the light will remain on before being turned off by a mechanical timer 13 (FIG. 2). For example, the timer may be set for 30, 40 or 60 minutes or some intermediate amount of time according to an indicator (not shown) on the knob 14 and indicia on the outer surface 6 of the replacement cover plate 4.

In a first embodiment of the invention, the knob 14 and timer 13 may incorporate a rotatable mechanical timer switch and push button switch as a single assembly wherein a light may be turned on for a pre-selected period of time by rotating the knob 14 or turned on or off by pushing the knob 14.

A second embodiment of the invention is illustrated in FIGS. 3 and 4 which is operable to turn a second light on or off and used to replace a multiple toggle switch of the type commonly used in offices and residences.

As illustrated in FIGS. 3 and 4, the second embodiment of the invention includes a second rotatable knob 114 which is disposed on the outer surface 6 of the replacement cover plate 4 adjacent to but spaced from the knob 14. The second knob 114 is connected to a second timer switch 113 in the same manner as the knob 14 is connected to the timer switch 13. As illustrated, the knob 114 and timer switch 113 serve a dual purpose, i.e., a single assembly serves two purposes, i.e., as a rotatable timer switch and a push button switch.

FIG. 5 is a schematic illustration of the mechanical timer switch assembly 2 in accordance with the first embodiment of the invention. As shown therein, the switch assembly 2 includes a replacement cover plate 4 having an outer surface 6 and an inner surface 8 and a rotatable knob 14 is disposed on the outer surface 6 by means of a shaft assembly 20. The shaft assembly 20 passes through an opening 17 in the cover plate 4. The shaft assembly 20 is constructed and arranged to act as a push button actuator and as a mechanical rotatable timer to open and close an electrical circuit to turn a light on or off by means of an actuator plate 23 which is constructed and arranged to open and close a circuit which connects a light to a source of electrical energy. As shown schematically the actuator plate 23 includes a pair of openings for connecting the switch to a source of electrical energy.

Figure 6:
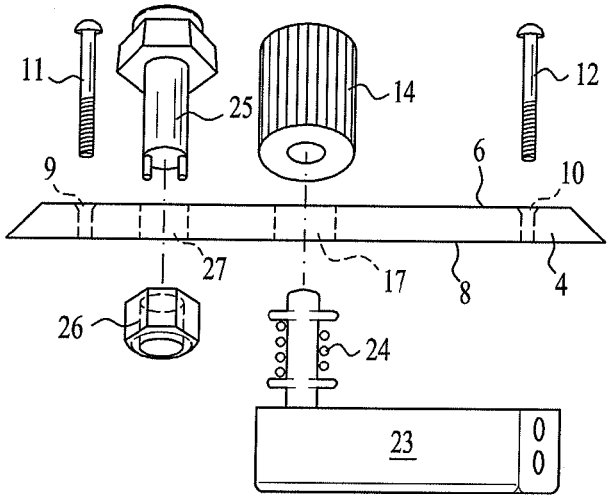
FIG. 6 is a schematic illustration of a mechanical timer switch in accordance with another embodiment of the invention.
Figure 7:
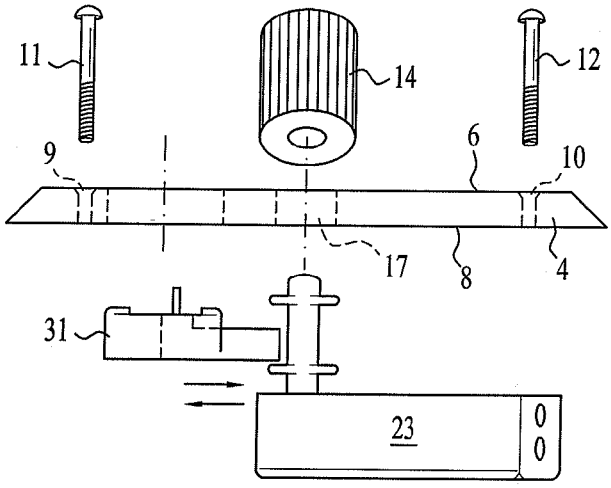
FIG. 7 is a schematic illustration of a mechanical timer switch in accordance with a still further embodiment of the invention.

A further embodiment of the invention is shown in FIG. 6 wherein a separate push button switch 25 is provided for turning a light (not shown) on or off independently of the mechanical rotatable switch 13 (FIG. 2). As illustrated the push button switch 25 extends through an opening 27 in the replacement cover plate 4 and is held in place by a conventional nut 26. The push button switch is of any conventional design. Also, in this embodiment of the invention, the mechanical timer switch 13 and knob 14 serves a single purpose, i.e., to turn a light on and then to automatically turn the light off after a pre-selected time. The rotating timer 13 is activated by a coil spring 24.

A second preferred embodiment of the invention which is preferably combined with the first preferred embodiment of the invention resides in means such as a slide switch 31 for stopping the rotation of the timer switch. The slide switch 31 is constructed and dimensioned to engage the shaft assembly 20 to prevent further rotation thereof in a manner to prevent a light being automatically turned off after being turned on for a pre-selected time.

Therefore, in a preferred embodiment of the invention the mechanical timer switch assembly 2 incorporates a rotatable timer switch 13 a push button switch 25 and slide switch 31 on the inner side 8 of the replacement cover plate 4 with the rotatable knob 14, push button switch 25 and slide switch 31 on the outer side 6 as shown in FIG. 10.

An electrical circuit of a type which may be used in the practice of the present invention is illustrated in FIG. 8. As shown in FIG. 8 a light bulb 40 may be turned on or off by either of the two switches 42 and 44. For example, the circuit is closed as shown in FIG. 8 and can be opened by changing either switch to extinguish the light and subsequently turned on by throwing either switch. This is a conventional circuit and is accomplished by means of a third wire 46.

An alternative circuit shown in FIG. 9 provides a common ground wire 50 and two separate switches 52 and 54 for turning a light 56 on or off. In this example each switch is independent of the other and if the light is turned on by one switch it cannot be turned off by the other.

While the invention has been described in connection with its preferred embodiments, it should be recognized that changes and modifications may be made therein without departing from the scope of the appended claims.

What is claimed is:

1. A mechanical timer switch assembly for replacing an electric toggle switch comprising:

a replacement cover plate having an inner and an outer side sized to fit over an electric receptacle box as a replacement for a conventional toggle switch cover plate;

a mechanical spring actuated rotary timer switch including a spring, a rotatable shaft and a contact member moveable by said shaft to open and close an electrical circuit, and said timer switch sized to fit into the electrical receptacle box and fixed to said inner side of said replacement cover plate with said shaft extending through said cover plate;

a knob fixed to said shaft outside of said replacement cover plate for rotating said shaft to close an electrical circuit and actuate said spring actuated rotary timer switch to open the circuit after a predetermined time;

a second mechanical switch fixed to said inner side of said replacement cover having an actuating member extending through said replacement cover for opening and closing the electrical circuit; and electrical circuit means connecting said mechanical spring actuated rotary timer switch, said second mechanical on/off switch to an electric light and a source of electrical energy so that the electric light can be switched on or off by either switch and wherein said electrical circuit means is a three way switch circuit and each of said switches is separately wired to turn a second light on and off independent of the other switch and which includes an inner housing with said mechanical spring actuated rotary timer switch disposed therein and said second mechanical switch is a push button switch and wherein said mechanical timer switch assembly includes a flat rectangular actuator plate for opening and closing an electrical circuit.

2. A mechanical timer switch assembly according to claim 1 in which said replacement switch cover plate has a pair of counter sunk openings which correspond to a pair of countersunk openings in a conventional toggle switch cover plate for fixing said replacement cover plate to an electrical receptacle box.

3. A mechanical timer switch assembly according to claim 2 which includes means for stopping the rotation of said shaft of said mechanical spring actuated timer switch to thereby prevent said timer switch from opening said circuit.

4. A mechanical timer switch assembly according to claim 3 in which said means for stopping rotation of said shaft is a slide mechanism for engaging said rotary timer switch.

5. A mechanical timer switch assembly according to claim 2 which includes a second mechanical spring actuated rotary timer switch and an additional mechanical switch for connecting a source of electrical energy to a second electrical light and wherein said second mechanical spring actuated rotary timer switch and said additional switch are fixed to said inner side of said replacement switch cover sheet.

6. A mechanical timer switch assembly according to claim 1 which includes means for preventing said mechanical spring actuated rotary timer switch from automatically turning said electric light on after the light has been turned off by said mechanical spring actuated rotary timer switch and off by said second mechanical switch before a pre-selected time on said mechanical spring actuated rotary timer switch has elapsed.

* * * * *